United States Patent [19]

Miller

[11] 4,141,513

[45] Feb. 27, 1979

[54] DEVICE FOR ACCELERATING YARN WINDER CHUCKS

[75] Inventor: Harry B. Miller, Charlotte, N.C.

[73] Assignee: Industrie-Werke Karlsruhe Augsburg Aktiengesellschaft, Fed. Rep. of Germany

[21] Appl. No.: 901,783

[22] Filed: May 1, 1978

[51] Int. Cl.[2] ..... B65H 54/02; B65H 54/42

[52] U.S. Cl. ..... 242/18 A; B65H/67/04

[58] Field of Search ..... 242/18 DD, 242/18 A, 242/18 DD, 18 PW, 25 A

[56] References Cited

U.S. PATENT DOCUMENTS

| | | | |
|---|---|---|---|
| 2,957,635 | 10/1960 | Bisbe | 242/18 A |
| 3,334,827 | 8/1967 | Jackson | 242/18 A |
| 3,628,741 | 12/1971 | Enneking et al. | 242/18 DD |
| 3,642,217 | 2/1972 | Sistare et al. | 242/18 DD X |
| 3,697,007 | 10/1972 | Taylor et al. | 242/18 A X |
| 3,845,911 | 11/1974 | Wyatt | 242/18 DD |
| 3,876,161 | 4/1975 | Miller | 242/18 A |

FOREIGN PATENT DOCUMENTS

| | | | |
|---|---|---|---|
| 2523771 | 12/1975 | Fed. Rep. of Germany | 242/18 A |

*Primary Examiner*—Stanley N. Gilreath
*Attorney, Agent, or Firm*—McGlew and Tuttle

[57] ABSTRACT

The device provides for winding much larger yarn packages on each of a pair of vertically spaced yarn winder chucks on one side of a common drive roll and displaceable alternately in respective slots of a front wall of the yarn winder into engagement with the drive roll for winding of yarn packages and bobbins on the chucks. An adjustable length arm is swingably mounted, through an anti-friction bearing, on a motor drive shaft extending through the front wall midway between the chuck slots and outwardly of the retracted positions of the chucks, and a small diameter pulley is rotatably mounted on the free end of the arm. A larger diameter pulley is fixed to the drive shaft, and a belt is trained around both pulleys. A pair of solenoids, having armatures spring biased outwardly, are aligned in opposition and their armatures engage a fin projecting from the pivot end of the arm to bias the arm to a neutral position in which the belt is out of the paths of movement of the chucks. While yarn packages are being wound on bobbins on one chuck, the idle chuck is moved past the incompletely wound packages to a standby position adjacent to, but out of contact with, the drive roll. Upon signal, one solenoid is energized to retract its armature and the other armature swings the arm to engage the belt portion trained around the small diameter pulley with the idle chuck. The drive motor is then energized to gradually accelerate the idle chuck to a peripheral speed substantially synchronized with that of the drive roll, after which the thus accelerated chuck is moved to engage its bobbins with the drive roll. Thereafter, the one solenoid and the motor are de-energized, and the device is biased to its neutral position.

As the belt is driven only intermittently for short periods of time, belt wear is greatly reduced.

10 Claims, 4 Drawing Figures

DEVICE FOR ACCELERATING YARN WINDER CHUCKS

FIELD OF THE INVENTION

This invention relates to multi-chuck, high speed yarn winders and, more particularly, to a device for accelerating an idle chuck to an angular velocity in which its peripheral speed is substantially synchronized with the peripheral speed of a drive roll with which the chuck, or bobbins mounted thereon, are to be engaged.

BACKGROUND OF THE INVENTION

Modern high speed winders, for winding yarn into yarn packages on bobbins mounted on chucks, generally include two or more rotatable chucks each supporting one or more bobbins. Usually, the chucks are arranged in pairs on opposite sides of the support or housing for a yarn traverse mechanism, with each pair being associated with a common drive roll positioned adjacent the traverse support or housing. While yarn packages are thus being wound on bobbins on one chuck, empty bobbins are placed on the second chuck, which is then in a retracted position. When full packages have been wound on the bobbins on the first chuck, the yarn is transferred to bobbins on the second chuck and the first chuck is retracted and brought to a stop, after which the full packages are removed therefrom.

The fed yarn can be transferred from a full package to an empty bobbin or bobbins on the second chuck manually by a winder operator or attendant, who has to thread the yarn properly for winding on the bobbin on the second chuck. However, such manual re-threading or re-guiding of the yarn, when full packages have been wound, so that the yarn can begin to be wound on empty bobbins, requires a considerable amount of time and, more importantly, a substantial waste of yarn, particularly when yarns are being fed at very high speeds.

A much faster and very highly efficient transfer of yarn from a full package on one chuck of a pair to an empty bobbin on the other chuck of the pair can be effected by the mechanism and method shown, described, and claimed in the inventor's co-pending U.S. Pat. Application, Ser. No. 809,676, filed June 24, 1977, and by the mechanism and method shown, described, and claimed in the inventor's U.S. Pat. Application Ser. No. 690,967, filed May 28, 1976, now U.S. Pat. No. 4,081,149.

With both manual transfer of the yarn from a full package on one chuck to an empty bobbin on the other chuck, or when such transfer is effected by the mentioned methods and mechanisms, the bobbin or bobbins on the previously inactive or idle chuck must be brought into driving engagement with a common drive roll. It is thus necessary to move the previously inactive or idle chuck horizontally, from a retracted position, past the package being wound on the then active chuck and into engagement with the drive roll. The necessity of leaving sufficient clearance for the inactive chuck, with a bobbin or bobbins mounted thereon, to be moved horizontally past the yarn package being wound on an active chuck, has limited seriously the diameter of the package being wound on the active chuck.

This limitation of the size of the packages which can be wound is of great importance when it is considered that the sector of the textile industry which involves man-made fiber production is becoming more competitive year by year with foreign production and more competitive domestically. As a result, there is a great necessity to improve production speeds with a minimum cost of capital equipment. To attain these ends, the man-made fiber processors are constantly expanding their capability of making yarn at higher spinning speeds and with more threads per spinning position. Because there are now more threads per spinning position, the bottleneck for this expansion is the requirement for a winder which has higher speed capability and winds more and larger packages. Thus, in order to be able to use existing spinning processing machinery and plant facilities, such a winder is a key objective as, without such a winder, complete new processing facilities have to be built at continually higher costs for machinery.

A mechanism and method by means of which acceptably larger packages can be wound on existing winders is shown, described, and claimed in U.S. Application Ser. No. 896,051 filed Apr. 13, 1978. In this latter mechanism and method, the inactive or idle chuck, carrying empty bobbins, is moved from a fully retracted position to a "standby" position shortly after the beginning of winding of packages on bobbins on the active chuck. As the package or packages near completion, the inactive chuck is accelerated until its peripheral speed, or that of the bobbins thereon, is substantially synchronous with that of the common drive roll and, as the winding of packages on the active chuck is completed, the inactive or idle chuck, or its bobbins, are brought into engagement with the drive roll and the yarn is then quickly transferred from the packages then being wound to the empty bobbins on the inactive chuck which is now rotating at high speed. As the inactive chuck has already "cleared" the packages then being wound on the active chuck, the packages can be wound to a much greater diameter and a much larger weight of yarn as there is no necessity for providing "clearance" for movement of the active chuck from a retracted position into engagement with the common drive roll.

To effect this, a belt is trained around the drive roll and engaged with a much smaller diameter pulley spaced somewhat from the drive roll toward the retracted positions of the chucks. After the winding of the package has been initiated on one chuck, namely the active chuck, the inactive chuck is brought from the fully retracted position to a position closely adjacent but out of contact with the belt. As the package being wound approaches completion, the inactive chuck is brought into engagement with a "soft" part of the belt so that the inactive chuck may be accelerated to a peripheral velocity substantially synchronous with that of the belt and the common drive roll. As winding of the package is fully completed, the inactive chuck is brought into direct engagement with that portion of the belt trained around the drive roll, or with the drive roll itself, and the yarn is transferred from the fully wound package to empty bobbins on the inactive chuck.

While this latter arrangement satisfactorily solves the problem of winding larger diameter packages on existing winders, it involves bringing a stationary bobbin or a stationary chuck into engagement with a belt travelling at high speed, which has a distinct disadvantage. More specifically, in very high speed winders operating at yarn speeds of 4 to 6 meters per minute, the friction when a bobbin engages the drive roll is such that the bobbin can actually be burned up, in addition to which there is a very high noise level, in the area of over 100 decibels, when the bobbin is engaged with the rapidly moving belt. While this disadvantage is ameliorated to some extent by initial engagement of the chuck or bobbin with a "soft" part of the belt, it is not completely obviated.

It has also been suggested that the inactive chuck could be brought up to speed, before engagement with the drive roll, by the use of a respective turbine or the like driving the inactive chuck. However, with such proposal separate turbine drives for each chuck would be necessary, which is a rather expensive proposition as four such turbine drives would be required for a high speed winder having two pairs of chucks, each associated with a respective common drive roll. An additional disadvantage of this proposal is that, using individual turbines to bring the chucks up to speed, the speed that could be obtained for any given chuck is only approximately the speed of the drive roll, this referring to linear speeds of the chucks and the drive roll, so that there would remain a substantial difference in peripheral velocities between the chuck and the drive roll when the chuck is engaged with the drive roll.

SUMMARY OF THE INVENTION

In accordance with the invention, there is provided a chuck accelerating device driven by a single electric motor and operable to accelerate either chuck of a pair, associated with a common drive roll, to a peripheral velocity substantially equal to the peripheral velocity of the common drive roll without the possibility of destruction of bobbins on the accelerated chuck by friction. Furthermore, the device provides for the winding of very substantially larger yarn packages on existing yarn winders without any substantial modification thereof except for the provision of the chuck accelerating device of the invention. For this latter purpose, a previously idle chuck is accelerated by the device of the present invention after this idle chuck has been moved from a retracted position past a partially wound package on the other chuck and to a standby position in which the previously idle chuck is adjacent, but out of contact with, the common drive roll, as is also a feature of the above-mentioned Patent Application Ser. No. 896,051. The accelerating device embodied in the invention is furthermore so arranged that it does not interfere with movement of either chuck of a pair between their retracted positions, their standby positions and their positions in which bobbins thereon are engaged with the common drive roll for winding of a yarn package thereon.

A feature of a so-called invention is that the accelerating device, when initially brought into engagement with a chuck then in the standby position, or with bobbins on the chuck, is not activated to rotate the chuck, but is idle. After such engagement, the driving motor for the accelerating device is energized and, as this driving motor is so-called "soft start" motor, it gradually accelerates the device and the chuck engaged thereby to an angular velocity at which the peripheral speed of the chuck, or of bobbins mounted thereon, is substantially synchronized with the peripheral speed of the drive roll. Hence, there is no danger of a bobbin or bobbins on the chuck being destroyed by friction either by the accelerating device or by engagement with the drive roll. While the device of the present invention accelerates the drive roll, then in the standby position, to an angular velocity such that its peripheral velocity is substantially equal to that of the common drive roll, the angular velocity of the accelerating device may differ from that of the common drive roll, in the case where the accelerated chuck has a diameter different from that of the common drive roll. However, where the chuck and the drive roll have equal diameters, the chuck will be accelerated to an angular velocity which is synchronized with the angular velocity of the drive roll.

More specifically, in a known yarn winder having a front wall formed with horizontal slots in which a pair of chucks are displaceable, by known mechanism, between a retracted position at the outer ends of the slots and an operative position in which they are engaged with the common drive roll, which extends forwardly from the front wall of the winder, the accelerating device of the invention comprises a motor having a motor drive shaft projecting through and outwardly from the front wall of the yarn winder at a position midway between the two slots for the chucks of one pair, and at a horizontal position adjacent or spaced outwardly from the outer ends of the slots in which the respective chucks are horizontally displaceable. More specifically, the drive shaft of the motor is located somewhat outwardly of the positions occupied by the chucks in their retracted position. An adjustable length arm is swingably mounted on the motor drive shaft, through the medium of anti-friction bearings, and the free end of the yarn rotatably mounts a relatively small diameter pulley. A larger diameter pulley is fixedly secured to the motor drive shaft, and a belt, preferably of flexible material, is trained around the two pulleys. Biasing means are operatively associated with the pivot end of the adjustable length arm, and normally bias this arm to a neutral position in which the relatively small diameter pulley is located substantially midway between the two chuck-receiving slots, with the entire device being positioned so that it does not interfere with the horizontal displacement of the chucks between their retracted positions and their operative positions in which they engage the common drive roll.

The biasing means comprises a pair of solenoids, which are arranged in aligned opposing relation and have armatures which are spring biased to extend outwardly from the solenoids. The two armatures engage respective opposite sides of a fin or the like on the pivot end of the adjustable length arm. With both solenoids de-energized, the respective spring biased armatures act in opposition to each other to maintain the arm in its neutral position.

The chuck accelerating device of the invention operates in a manner which will now be described. When a yarn package has begun to be wound on one chuck of the pair, by engagement of the bobbin and of the yarn package with the common drive roll rotating at a high angular velocity, the then idle chuck is moved from its retracted position past the partially wound yarn package to the standby position in which it is adjacent to, but out of engagement with, the common drive roll. Upon signal, one of the two solenoids is energized to retract its spring biased armature, whereupon the spring biased armature of the other and de-energized solenoid swings the arm about the axis of the motor drive shaft to engage that portion of the belt trained around the smaller diameter pulley with the chuck, or with a bobbin thereon, then in the standby position. At this time, the drive motor of the device is de-energized so that the belt is stationary. The drive motor of the device is then energized and accelerates from standstill to drive the belt then engaged with the chuck in the standby position, thus accelerating this chuck to an angular velocity at which the peripheral velocity of the chuck, or of a bobbin thereon, is substantially equal to, or is synchronized with, the peripheral velocity of the common drive roll. When this peripheral velocity of the chuck has been attained, the chuck is then displaced toward the common drive roll to engage a bobbin or bobbins thereon with the common drive roll, with both the common drive roll and the chuck rotating at substantially the same peripheral velocity. The drive motor of the accelerating device is then de-energized and the previously energized solenoid is de-energized, so that the device is again biased back to its neutral position. The same procedure is used to accelerate the other chuck of the pair, when a yarn package wound thereon has been removed therefrom and such other chuck has been moved to the standby position. As the belt is driven only intermittently for short time periods, wear of the belt is substantially reduced.

As a further feature of the invention, the common drive roll is provided with one or more rings or sleeves of an elastomer material, such as polyurethane, engageable with a chuck or with the bobbins thereon. Such provision, in addition to the previously mentioned features of the invention, results in a very substantial reduction in the noise usually characteristic of the start up of a new yarn package. In this connection, it should be noted that, in known high speed yarn winders, the noise level, during a switchover between chucks, is in the area of over 100 decibels. With the chuck accelerating device of the present invention, it is barely possible to hear the noise accompanying a switchover between chucks, and the noise level accompanying such a swtichover is reduced to well below the 75 - 85 decibels to which it is desirable to reduce the existing noise level of well over 100 decibels, the 75 - 85 decibels limit being that suggested by the Office Safety and Health Administration (OSHA).

An object of the invention is to provide an improved device for accelerating an idle chuck to a peripheral velocity substantially synchronized with the peripheral velocity of a common drive roll for a pair of such chucks.

Another object of the invention is to provide such a device which permits winding of very substantially larger or heavier yarn packages on existing high speed yarn winders.

A further object of the invention is to provide such a device in which destruction of bobbins by friction is substantially eliminated.

Yet another object of the invention is to provide such an accelerating device which requires only one device driving motor for each pair of chucks, as the device is selectively engageable with either of a pair of chucks then in a "standby" position.

A further object of the invention is to provide succh a chuck accelerating device which can be readily adjusted and maintained from the front side of a yarn winder.

Another object of the invention is to provide such a device which is simple in construction, inexpensive to manufacture, and reliable in operation.

For an understanding of the principles of the invention, reference is made to the following description of a typical embodiment thereof as illustrated in the accompanying drawings.

DESCRIPTION OF THE PREFERRED EMBODIMENT

Figure 1:
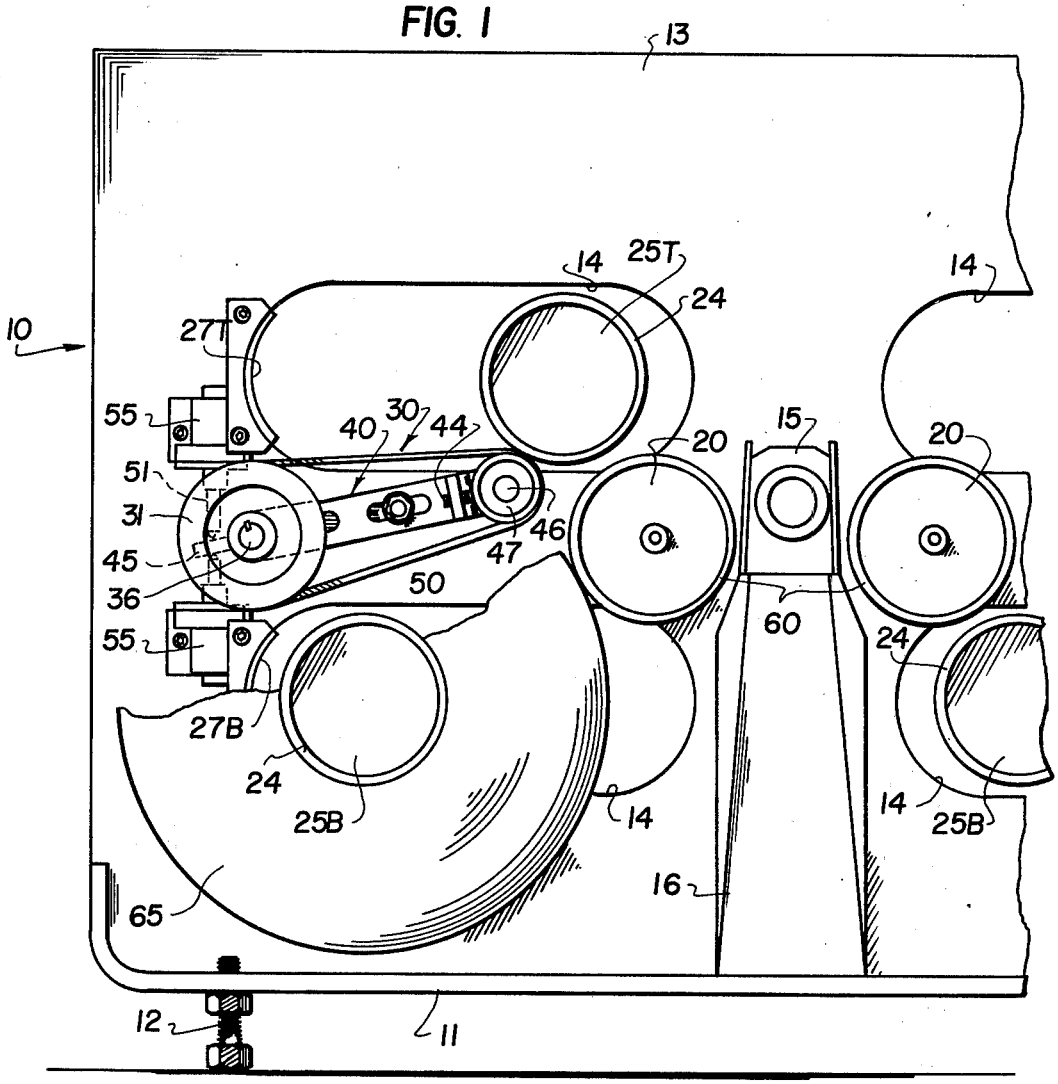
FIG. 1 is a partial front elevation view of a four-chuck high speed winder equipped with the chuck accelerating device of the invention.
Figure 4:
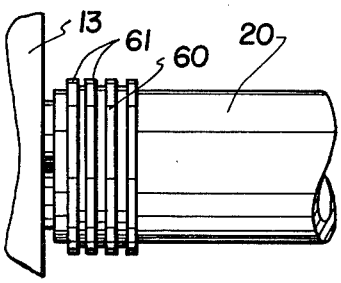
FIG. 4 is a partial side elevation view of one common drive roll of the winder illustrating the elastomer collar thereon for engaging a chuck.

Referring to the drawing, an essentially conventional, high speed, four-chuck yarn winder, generally indicated at 10, is partially indicated as including a base 11 mounted on adjustable studs 12 and an upright front wall 13 extending upwardly from base 11. Front wall 13 is formed with two pairs of vertically spaced, horizontally elongated slots 14, with the two pairs of slots being located on opposite sides of a traverse mechanism or assembly 15 mounted on a traverse assembly support 16 supported on base 11 at substantially the center thereof. These slots 14 are for a purpose to be described. In addition, front wall 13 is formed with an opening 17, also for a purpose to be described hereinafter.

Drive rolls 20, 20, each driven in a conventional manner, are provided on opposite sides of traverse assembly 15, and each drive roll 20 is common to a respective pair of chucks 25T, 25B, the chucks of each pair being spaced vertically from each other and being movable, in respective slots 14, between a fully retracted position, at the outer ends of these slots as viewed in FIG. 1, and an active position in which they are engaged with the common drive roll 20, the active position being at the inner ends of the respective slots. As the arrangement to the right of traverse assembly 15, as viewed in FIG. 1, is essentially a mirror image of that to the left of traverse assembly 15, only the arrangement to the left of the traverse assembly will be described in some detail. The winder may be provided with a "transfer tails" mechanism, mounted on traverse assembly support 16, such as the transfer tails mechanism shown in Applicant's U.S. Pat. No. 4,081,149 issued Mar. 28, 1978.

In accordance with conventional practice, each chuck 25T, 25B is rotatably supported in a respective chuck support (not shown) for movement horizontally of the associated slot 14. At the outer end of each slot 14, there is a respective chuck brake 27T, 27B with which the chuck may be engaged when it is moved to its fully retracted position, to decelerate the chuck to a standstill for "doffing" of wound packages therefrom. Furthermore, the opening 17 in upright front wall 13 is located midway between the associated pair of slots 14, 14, and substantially aligned with the respective chuck brakes 27T, 27B, or slightly outwardly of the outer ends of the associated slots 14, 14.

All of the mechanism so far described is essentially conventional in high speed, four-chuck yarn winders, so that further detailed description of the winder 10 is believed unnecessary.

In accordance with the invention, two accelerating devices 30, embodying the invention, are provided for the winder 10, one device 30 being associated with the left hand pair of chucks 25T, 25B, and the other device 30 being associated with the right hand pair of chucks 25T, 25 B. Only the device 30 associated with the left hand pair of chucks is illustrated and will be described in detail, it being understood that the device 30 associated with the right hand pair of chucks is identical in construction with the device 30 associated with the left hand pair of chucks.

The major portion of each device 30 is mounted on front wall 13 adjacent the front surface of the latter so as to be easily accessible for adjustment, maintenance and repair. Each device 30 includes a respective drive motor 35 mounted within the winder 10, that is rearwardly of the front wall 13, and motor 35 is an A.C. motor which may be supplied from conventional A.C. mains, but preferably is supplied from an adjustable frequency inverter which also supplies the power for operating the motor driving the associated drive roll 20. Motor 35 has an output or drive shaft 36 which extends outwardly, with clearance, through the opening 17 in front wall 13 and serves to support the major portion of the chuck accelerating device 30.

Figure 2:
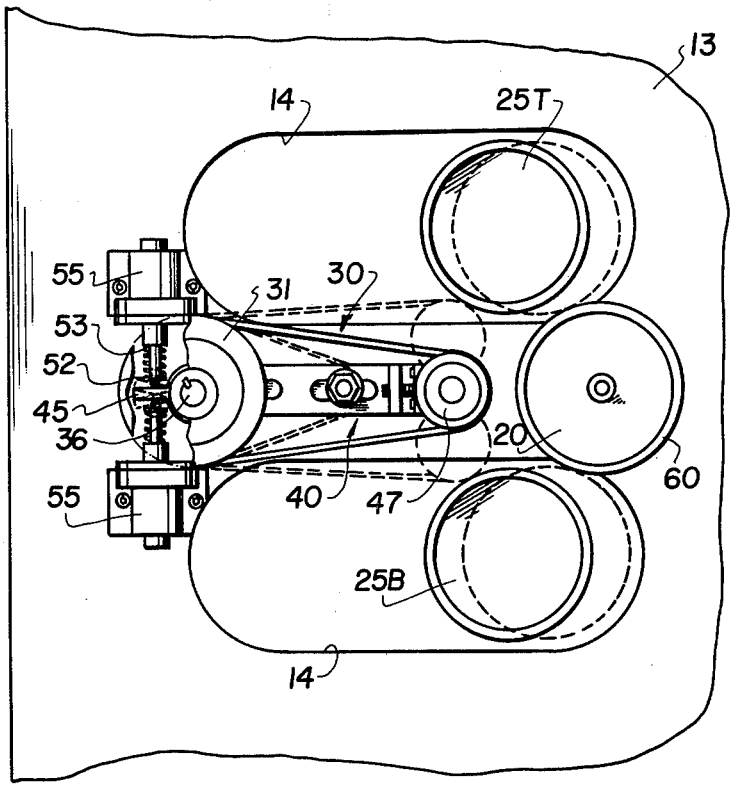
FIG. 2 is a partial front elevation view of the winder illustrating the accelerating device in greater detail.
Figure 3:
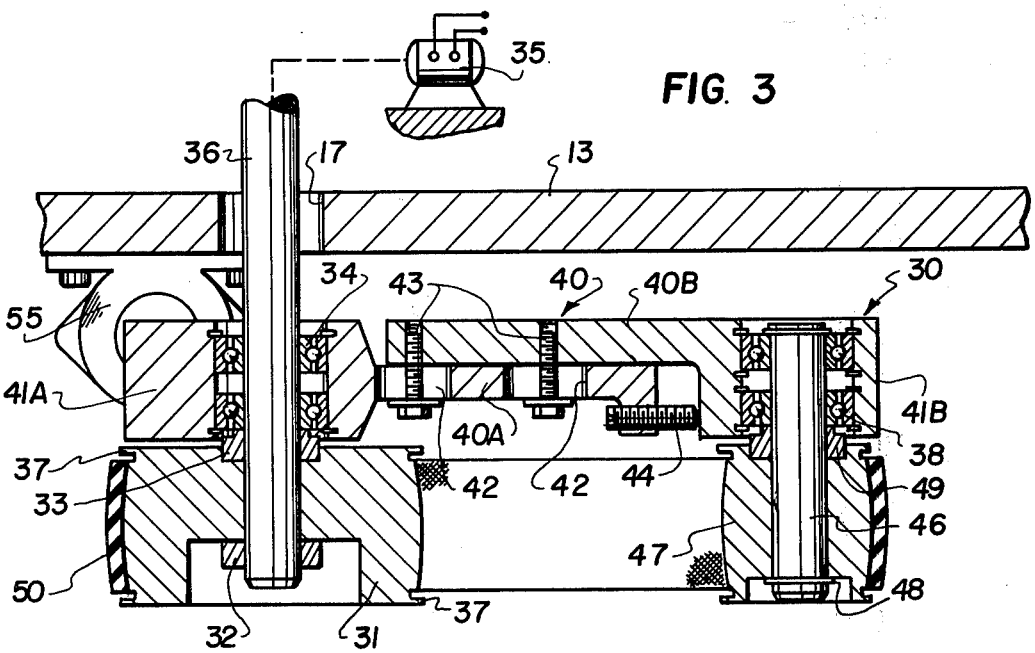
FIG. 3 is a horizontal sectional view through the chuck accelerating device in its neutral position.

A relatively large diameter drive pulley 31 is secured to drive shaft 36, being held between a locking collar 32 and a spacer 33 engaging an anti-friction bearing 34 on shaft 36. Drive pulley 31 is fixed to rotate with shaft 36, either by being keyed thereto or by being locked thereto through collar 32, and has a concave peripheral surface with flanges 37 at its axially opposite ends. An adjustable length arm 40 is rotatably mounted on drive shaft 36 through the medium of anti-friction bearing 34. Arm 40 comprises a first arm section 40A having a hub 41A embracing anti-friction bearing 34, and a second arm section 40B having a hub 41B. Inner arm section 40A is formed with a pair of elongated slots 42 each of which receives a respective cap screw 43 threaded into outer arm section 40B. A set screw 44, threaded through the outer end of inner arm 40A, abuts against the hub 41B of outer arm 40B. By virtue of set screw 44, the overall length of arm 40 can be readily adjusted by loosening cap screws 43, adjusting set screw 44 and re-tightening cap screws 43. It will be noted that this adjustment can be readily effected from the front of the winder 10. For a purpose to be described hereinafter, hub 41A of inner arm 40 is formed with a radially outwardly projecting rib or fin 45, as best seen in FIGS. 1 and 2.

A second anti-friction bearing 38 is mounted in hub 41B of outer arm or arm section 40B, and rotatably mounts a shaft 46 affixed to a driven pulley 47 which is held between a retaining ring 48, on shaft 46, and a spacer 49 engaging anti-friction bearing 38. Driven pulley 47 has exactly the same configuration as driving pulley 31, but has a much smaller diameter. A flexible belt 50 is trained around the pulleys 31 and 47, so that pulley 47 is driven at a much higher angular velocity than that imparted to driving pulley 31 by motor 35 and shaft 36.

A pair of solenoids 55 are mounted on front wall 13 of winder 10, with their spring biased armatures 51 in alignment with each other and engaged with opposite surfaces of the fin or rib 45 on the hub 41A of inner arm section 40A. Each armature 51 has a flange 52 adjacent its outer end, and is embraced by a coil spring 53 engageable with this flange. The solenoids 55 are identical with each other and, when the two solenoids are de-energized, their armatures are biased outwardly by the respective springs 53. Normally, the solenoids 55 maintain the chuck accelerating device 30 in the neutral position shown in solid lines in FIG. 2. However, when either solenoid 55 is energized, it retracts its armature 51 against the bias of the associated coil spring 53, so that the spring biased armature 51 of the opposing solenoid 55 is projected further outwardly by its associated spring 53 to swing the accelerating device 30 to one of the operative positions shown in broken lines in FIG. 2 and one of which is shown in solid lines in FIG. 1. The operation of the device 30 and particularly of the solenoids 55 will be described more fully hereinafter.

Each drive roll 20 is formed or provided with one or more elastomer rings or sleeves 60, preferably of polyurethane, and each sleeve is formed with ribs 61 which extend outwardly a short distance from the peripheral surface of the associated drive roll, the rings 60 being "inset" into peripheral grooves in each drive roll and anchored therein in a suitable manner. When an idle or inactive chuck, which has been accelerated to a peripheral speed synchronized with the peripheral speed of the associated drive roll 20 is brought into active cooperation with the associated drive roll 20, the bobbin 24 thereon engages the elastomer ring or rings on the drive roll, thus further reducing the noise characteristic of changeover of the yarn feed from one chuck to another chuck, this noise being further reduced by virtue of the provision of the ribs 61 on the elastomer or polyurethane rings 60. It should also be noted, at this point, that the motor 55 is a so-called "soft start" motor which means that, when the motor is energized, it does not abruptly come up to full speed, but rather accelerates gradually. This not only prevents possible destruction of a bobbin, but also further greatly reduces the noise incident to changeover of yarn feed from one chuck of the pair to the other chuck of a pair and greatly reduces belt wear.

The operation of the chuck accelerating device 30 will now be described in detail. Initially, motor 35 and solenoids 55 are de-energized. With the solenoids de-energized, their armatures 51 are biased outwardly by the associated coil springs 33 so that the armatures engage the rib or fin on the hub 41A of the adjustable length arm 40. Consequently, the accelerating device 30 is maintained in the neutral position shown in FIG. 2, in which it is out of the path of movement of the upper chuck 25T and the lower chuck 25B in their respective slots 14. Each chuck is movable between three different positions, namely a fully retracted position in which it is engaged with its associated brake 27, an operative position at the inner end of the associated slot 14 in which a bobbin 24 thereon is engaged with the common drive roll 20, or rather with the elastomer sleeve 60 thereon, and a "standby" position shown in solid lines in FIGS. 1 and 2, in which it is adjacent the associated drive roll 20 but with its bobbin 24 out of contact with the drive roll.

In the specific example illustrated in the drawings, when a yarn package 65 has begun to be wound on a bobbin 24 on the lower chuck 25B, hereinafter referred to as the "active" chuck, and before this yarn package has attained an appreciable diameter, the upper chuck 25T, hereinafter referred to as the "inactive" or "idle" chuck, is moved from a fully retracted position to the standby position shown in solid lines in FIG. 1. Thus, the idle or inactive chuck 25T has been moved past the growing yarn package 65 so that it does not interfere with winding of a very large package 65 on the bobbin 24 on the lower active chuck 25B. This enables the winding of much larger packages on the chuck than would be possible if it were necessary to move the idle upper chuck 25T from its idle retracted position past the yarn package 65 and into either the standby position or the operative position.

When the package 65 being wound on a bobbin 24 on the lower chuck 25B nears completion, and upon signal, the lower solenoid 55 is energized to retract is armature 51. Thereupon, under the bias of its spring 53, the armature 51 of the de-energized upper solenoid 55 is further extended, in engagement with the rib or fin 45, to swing the adjustable length arm 40 counter-clockwise about the output or drive shft 36 of the still idle motor 35 and to engage that portion of belt 50 trained around driven pulley 47 with a bobbin 24 on the chuck 25T in the "standby" position. Motor 35 is then energized and gradually accelerates to its full speed, thus driving the belt 50 at an increasing speed and gradually accelerating the angular velocity of the idle upper chuck 25T. The full speed of motor 35 is so selected that, when the motor attains its full speed, the idle chuck 25T has been accelerated to an angular velocity such that its peripheral speed is substantially synchronized with the peripheral speed of the drive roll 20 having the elastomer sleeve or sleeves 60 thereon. At this time, the thus accelerated chuck 25T is moved from the standby position, shown in solid lines in FIG. 1, into the position shown in dotted lines in FIG. 2 where a bobbin 24 thereon engages the elastomer sleeve or sleeves on the common drive roll 20. There is substantially no friction effective upon the bobbin, so that destruction of the bobbin is prevented. Furthermore, the noise usually attendant upon such engagement of an idle chuck with the drive roll is very substantially reduced so that it is hardly possible to hear the noise of the changeover. More specifically, the usual level of the noise, characteristic of winders during a changeoever operation and without the device of the invention, is over 100 decibels. With the present arrangement, the noise level is reduced to below 75 - 85 decibels, which is well below the noise level desired by OSHA.

After the chuck 25T, or rather its bobbin 24, has been brought into driving engagement with the elastomer sleeve or sleeves on the common drive roll 60, lower solenoid 55 is de-energized so that its armature 51 is again spring biased toward its outermost position whereby the adjustable length arm 40 is swung clockwise back into the neutral position shown in FIG. 2, and motor 35 is de-energized. The yarn can then be transferred from the yarn package 65 to the empty bobbin 24 on the chuck 25T, either manually or by an automatic yarn transfer apparatus such as shown in Applicant's co-pending patent applications Ser. No. 809,676, filed June 24, 1977, and Ser. No. 690,967, filed May 28, 1976, now U.S. Pat. No. 4,081,149. Essentially the same operation takes place when accelerating a then empty bobbin on the lower chuck 25B so that its peripheral speed is synchronized with the peripheral speed of the associated drive roll 20. In this case, when activated, the device 30 is swung clockwise from the neutral position shown in FIG. 1 to engage the belt 50 with the empty bobbin 24 on the then idle lower chuck 25B in its respective standby position.

The chuck acceleration device of the invention has a very considerable advantage that it prevents "burning up" of the bobbins, which occurs when a bobbin is engaged with a drive roll rotating at a very high speed and the bobbin happens to be stationary when it hits the drive roll. It furthermore has a very substantial advantage over alternative methods, such as those using respective turbines to accelerate idle chucks to an angular velocity approaching that of the common drive roll. The turbine arrangement not only requires a tremendous amount of high pressure air, but the final speed of the empty chuck is only approximately that of the peripheral speed of the drive roll. Furthermore, individual turbines are necessary for each of the chucks.

Both the motor driving the drive roll 20 and motor 35 are driven from the same inverter, that is, the same A.C. power source. However, the acceleration device can be operated with D.C. motors and also attain synchronism of the two peripheral velocities. Usually, however, the power available in a plant is A.C. plant such as 60 cycles. If a D.C. source were available, it could be supplied to an inverter and a suitable A.C. frequency could be selected for application to the motor, such as the motor 35. On the other hand, with the device of the present invention, only a single driving motor is necessary for accelerating either of a pair of chucks, not at the same time, but in alternation with each other. The motors 35 actually run for only very short periods of time, at start-up, so that the risk of overheating and the like is considerably reduced, and belt wear is also great reduced.

While a specific embodiment of the invention has been shown and described in detail to illustrate the application of the principles of the invention, it will be understood that the invention may be embodied otherwise without departing from such principles.

What is claimed is:

1. A chuck accelerating device, for use in a winder for yarn and the like of the type including at least one pair of axially spaced rotatable chucks each adapted to have at least one bobbin mounted thereon and including a respective drive roll operatively associated with each pair of chucks, with each chuck being movable from a retracted position through a standby position toward the associated drive roll for rotation of the respective chuck by engagement of a bobbin or bobbins thereon with the associated drive roll for winding of the yarn package on each bobbin, and being retractable from the drive roll, with one chuck of each pair being rotated by the drive roll while the other chuck is idle, and the idle chuck being moved past the yarn package or packages being wound onto one chuck to the standby position, in which it is adjacent to but out of contact with the drive roll, prior to the yarn package or packages being wound on the one chuck attaining a size interfering with such movement of the idle chuck: said chuck accelerating device comprising, in combination, a driven pulley; a drive belt trained around said driven pulley; means mounting said driven pulley for movement between a neutral position, in which said drive belt is spaced from the path of movement of both chucks of a pair, and a pair of operative positions, in each of which said drive belt is engaged with an idle chuck of each pair then in the standby position; means biasing said driven pulley to its neutral position and operable, upon signal, to move said driven pulley to a selected one of its operative positions; and drive means operatively associated with said drive belt and operable, when said driven pulley is moved through either one of its operative positions, to accelerate said driven pulley from standstill to an angular velocity in which the peripheral speed of said drive belt, and thus of the idle chuck engaged thereby, is substantially synchronized with that of said drive roll; the thus accelerated idle chuck being thereupon moved to engage a bobbin or bobbins thereon with said common drive roll for rotation by said common drive roll.

2. A chuck accelerating device, as claimed in claim 1, including at least one sleeve of an elastomer material, on each common drive roll and projecting slightly radially therefrom for engagement with a bobbin or bobbins on a chuck to be rotated by said common drive roll.

3. A chuck accelerating device, as claimed in claim 1, in which said drive means includes an electric motor which is de-energized until said drive belt is engaged with an idle chuck then in a standby position, and is then gradually accelerated to an angular velocity at which the peripheral speed of the chuck is substantially synchronized with the peripheral speed of said common drive roll.

4. A chuck accelerating device, as claimed in claim 3, in which said winder has an upright front wall formed with respective slots for movement of the chucks between their several positions; said electric motor having a driving shaft extending through an aperture in said front wall at a location midway between the slots for a respective pair of chucks and displaced somewhat outwardly from those ends of the slots in which the chucks are located in their retracted positions; adjustable length arm means swingably mounted, at a pivot end, on said drive shaft adjacent the outer surface of said front wall; and means rotatably mounting said driven pulley on the free opposite end of said adjustable length arm means.

5. A chuck accelerating device, as claimed in claim 4, including a drive pulley secured to said motor drive shaft for rotation therewith; said belt being trained around said drive pulley and said driven pulley.

6. A chuck accelerating device, as claimed in claim 5, in which said adjustable length arm means includes an inner arm having a first hub rotatably mounted on said motor drive shaft and an outer arm, adjustably mounted on said inner arm, and having a second hub rotatably mounting said driven pulley; a fin projecting radially outwardly from said first hub; said biasing means including spring biased means engaging opposite sides of said fin and normally maintaining said adjustable length arm means in a neutral position.

7. A chuck accelerating device, as claimed in claim 6, in which said first arm is formed with plural elongated slots; and screw means extending through said slots and threadedly engaged in said second arm; whereby said second arm may be adjusted longitudinally relative to said first arm.

8. A chuck accelerating device, as claimed in claim 7, including a set screw threaded through the outer end of said first art and engaging said second hub; whereby adjustment of the length of said adjustable length arm means may be effected by loosening said screw means and operating said set screw followed by re-tightening of said screw means; said screw means and said set screw being accessible from the front of said winder.

9. A chuck accelerating device, as claimed in claim 6, in which said spring biased means comprises two solenoids mounted on said front wall of said winder and having respective armatures in opposed axial alignment with each other and engaging said fin; spring means biasing said armatures outwardly of the respective solenoids when the respective solenoids are de-energized, to engage opposite sides of said fin to maintain said adjustable length arm means in the neutral position; each solenoid, when energized, retracting its associated armature whereby the armature of the other solenoid, under the influence of the spring means, is further advanced to swing said adjustable length arm means to move the portion of said belt engaged with said driven pulley into engagement with a bobbin mounted on a chuck, then in its standby position.

10. A chuck accelerating device, as claimed in claim 6, including a first anti-friction bearing in said first hub engaged with said motor drive shaft; a second anti-friction bearing in said second hub; and a further shaft mounted in said second anti-friction bearing; said driven pulley being secured to said second shaft.

* * * * *

UNITED STATES PATENT OFFICE

CERTIFICATE OF CORRECTION

Patent No. 4,141,513 Dated February 27, 1979

Inventor(s) Harry Miller

It is certified that error appears in the above-identified patent and that said Letters Patent are hereby corrected as shown below:

Column 2, line 38, change "active" to --inactive--;
line 64, change "4 to 6 meters per minute" to --4000 to 6000 meters per minute--.

Column 3, line 65, change "drive roll" to --chuck--.

Column 4, line 25, after "and"insert --on--;
line 26, after "yarn" insert --is--; "yarn" should be changed to --arm--; and change "mounts" to --mounted--.

Column 6, line 53, change "of" to --in--.

Column 7, line 29, change "concave" to --convex--.

Column 8, line 30, change "55" to --35--;
line 42, change "33" to --53--.

Column 9, line 45, change "60" to --20--.

Signed and Sealed this

*Thirteenth* Day of *January 1981*

[SEAL]

*Attest:*

SIDNEY A. DIAMOND

*Attesting Officer*

*Commissioner of Patents and Trademarks*